US005524718A

United States Patent [19]

Kirk et al.

[11] Patent Number: 5,524,718

[45] Date of Patent: Jun. 11, 1996

[54] EARTH-BORING BIT WITH IMPROVED BEARING SEAL ASSEMBLY

[75] Inventors: Philip B. Kirk, Houston; George E. Dolezal, Friendswood, both of Tex.; Ronald R. Campbell, Upland, Calif.

[73] Assignee: Baker Hughes Incorporated, Houston, Tex.

[21] Appl. No.: 381,692

[22] Filed: Jan. 31, 1995

[51] Int. Cl.[6] ..... E21B 10/22

[52] U.S. Cl. ..... 175/371; 277/95; 384/94

[58] Field of Search ..... 175/371, 228, 175/372; 384/94; 277/95, 96.2

[56] References Cited

U.S. PATENT DOCUMENTS

| | | | |
|---|---|---|---|
| 3,075,781 | 1/1963 | Atkinson et al. | 277/83 |
| 3,365,247 | 1/1968 | Ferrand | 384/94 X |
| 3,397,928 | 8/1968 | Galle | 384/93 |
| 3,862,762 | 1/1975 | Millsap | 277/92 |
| 4,466,621 | 8/1984 | Garner et al. | 277/84 |
| 4,588,309 | 5/1986 | Uyehara et al. | 384/94 |
| 4,747,604 | 5/1988 | Nakamura | 277/83 |
| 4,757,110 | 7/1988 | Sato | 525/78 |
| 4,822,057 | 4/1989 | Chia et al. | 277/84 |
| 4,824,123 | 4/1989 | Chia et al. | 277/84 |
| 4,849,295 | 7/1989 | Dickerman et al. | 428/457 |
| 4,851,068 | 7/1989 | Uyehara | 156/245 |
| 4,978,409 | 12/1990 | Fujiwara et al. | 156/315 |
| 5,129,471 | 7/1992 | Maurstad et al. | 175/228 |
| 5,152,353 | 10/1992 | Denton et al. | 175/228 |
| 5,323,863 | 6/1994 | Denton | 175/57 |
| 5,402,858 | 4/1995 | Quantz et al. | 175/371 |
| 5,456,327 | 10/1995 | Denton et al. | 175/371 |

*Primary Examiner*—Hoang C. Dang
*Attorney, Agent, or Firm*—Charles D. Gunter, Jr.

[57] ABSTRACT

An earth-boring bit has a bit body, at least one cantilevered bearing shaft, including a base and a cylindrical journal bearing surface extending inwardly and downwardly from the bit body, and at least one cutter mounted for rotation on the cylindrical journal bearing surface of the bearing shaft. A seal assembly is disposed between the cylindrical journal bearing surface and the cutter proximally to the base of the cantilevered bearing shaft. The seal assembly includes at least one resilient sealing ring which is formed of a carboxylated hydrogenated acrylonitrile butadiene rubber.

9 Claims, 1 Drawing Sheet

EARTH-BORING BIT WITH IMPROVED BEARING SEAL ASSEMBLY

BACKGROUND OF THE INVENTION

1. Field of the Invention

The present invention relates generally to earth-boring bits, especially the seal and lubrication systems for earth-boring bits of the rolling cutter variety. More particularly, the present invention relates to an improved O-ring and seal assembly for improving the abrasion resistance and wear characteristics of rolling cutter bits by more effectively retaining the lubricant around the journal bearings of such earth-boring bits.

2. Background Information

The rotary rock bit was an important invention that enabled the discovery of deep oil and gas reservoirs. Only soft earthen formations could be penetrated commercially with the earlier drag bit which drilled only a scant fraction of the depth and speed of the modern rotary rock bit. Modern rock bits sometimes drill for thousands of feet instead of merely a few feet. Many advances have contributed to the impressive improvement of earth-boring bits of the rolling cutter variety.

The modern earth boring bit employs one or more, typically three, rolling cone cutters rotatably mounted thereon. The bit is secured to the lower end of a drillstring that is rotated from the surface or by downhole motors. The cutters mounted on the bit roll and slide upon the bottom of the borehole as the drillstring is rotated, thereby engaging and disintegrating the formation material. The rolling cutters are provided with teeth that are forced to penetrate and gouge the bottom of the borehole by weight from the drillstring.

As the cutters roll and slide along the bottom of the borehole, the cutters, and the shafts on which they are rotatably mounted, are subjected to large static loads from the weight on the bit, and large transient or shock loads encountered as the cutters roll and slide along the uneven surface of the bottom of the borehole. Thus, most earth-boring bits are provided with precision-formed journal bearings and bearing surfaces, as well as sealed lubrication systems to increase drilling life of bits. The lubrication systems typically are sealed to avoid lubricant loss and to prevent contamination of the bearings by foreign matter such as abrasive particles encountered in the borehole. A pressure compensator system minimizes pressure differential across the seal so that lubricant pressure is equal to or slightly greater than the hydrostatic pressure in the annular space between the bit and the sidewall of the borehole.

Early earth boring bits had no seals or rudimentary seals with relatively short life, and, if lubricated at all, necessitated large quantities of lubricant and large lubricant reservoirs. Typically, upon exhaustion of the lubricant, journal bearing and bit failure soon followed. An advance in seal technology occurred with the "Belleville" seal, as disclosed in U.S. Pat. No. 3,075,781, to Atkinson et al. The Belleville seal minimized lubricant leakage and permitted smaller lubricant reservoirs to obtain acceptable bit life.

The seal disclosed by Atkinson would not seal lubricant inside a journal-bearing bit for greater than about 50–60 hours of drilling, on average. This was partially due to rapid movement of the cutter on its bearing shaft (cutter wobble), necessitated by bearing and assembly tolerances, which causes dynamic pressure surges in the lubricant, forcing lubricant past the seal, resulting in premature lubricant loss and bit failure.

Improvements in journal bearing seals, in later years, included bits employing anti-friction ball or roller bearing elements. However, it was the O-ring, journal bearing combination disclosed in U.S. Pat. No. 3,397,928, to Galle that unlocked the potential of the journal-bearing bit. Galle's O-ring-sealed, journal-bearing bit could drill one hundred hours or more in the hard, slow drilling of West Texas. The success of Galle's design was in part attributable to the ability of the O-ring design to help minimize the aforementioned dynamic pressure surges.

It was discovered relatively early on that ordinary O-ring seals capable or providing adequate sealing in less demanding environments are inadequate in rock bits. Refinements in O-ring technology included choice of materials, configuration of the annular channel or groove in which the O-ring is confined and the degree of squeeze or compression on the O-ring in the assembled bit.

Typical O-ring materials used in the prior art include butadiene acrylonitrile (Buna N) rubber and ethylene/propylene/diene/monomer (EPDM) rubber or polymethylene.

Butadiene acrylonitrile rubber is based on a copolymer of butadiene with varying amounts of acrylonitrile. EPDM rubbers are a basic class of synthetic rubbers which have a basic polymer backbone built of copolymerized ethylene and propylene molecules, and side chains containing a double bond usable for cross-linking in a vulcanization or final curing step. The side chain is derived from a non-conjugated diene, such as 1,4-hexadiene, which is copolymerized in proper amounts with ethylene and propylene.

Despite improvements in the materials available for use as the resilient seal member of rock bit bearing seals, a need exists for such materials which provide more effective seals for journal bearing rock bits under the rigorous conditions encountered in down-hole drilling.

A need also exists for seal assemblies for rotary rock bits which more effectively seal between a stationary and a rotating surface.

A need exists for an improved O-ring seal assembly for retaining the lubricant within the rock bit over a prolonged useful life and over a full range of operating speeds.

A need also exists for such a bearing seal assembly employing an O-ring which is resistant to hydrocarbons or other chemical compositions found in the downhole environment, which has a high heat resistance and which does not unduly deform under changing loads to permit lubricant to escape the bit or to allow the ingress of external fluids into the bit interior.

SUMMARY OF THE INVENTION

It is a general object of the present invention to provide an improved bearing seal assembly for use in an earth-boring bit. The bearing seal assembly includes a resilient member which resists swell and more effectively resists lubricant leaks while preventing the ingress of foreign contaminants than did the prior art seal materials.

This and other objects of the present invention are accomplished by providing an earth-boring bit having a bit body, at least one cantilevered bearing shaft, including a cylindrical journal bearing surface extending inwardly and downwardly from the bit body, and at least one cutter mounted for rotation on the cylindrical journal bearing surface of the bearing shaft. A seal assembly is disposed between the cylindrical journal bearing surface and the cutter proximally to the base of the cantilevered bearing shaft. The seal assembly includes at least one resilient member which is formed of a functionally modified, butadiene acrylonitrile copolymer rubber which is hydrogenated and which is modified by the addition of polar groups to the polymer backbone. The preferred polar groups are carboxyl groups.

According to the preferred embodiment of the present invention, the resilient member of the seal assembly is formed predominantly of carboxylated hydrogenated acrylonitrile butadiene rubber.

Other objects, features, and advantages of the present invention will be apparent to those skilled in the art with reference to the figures and detailed description, which follow.

DESCRIPTION OF THE PREFERRED EMBODIMENT

Figure 1:
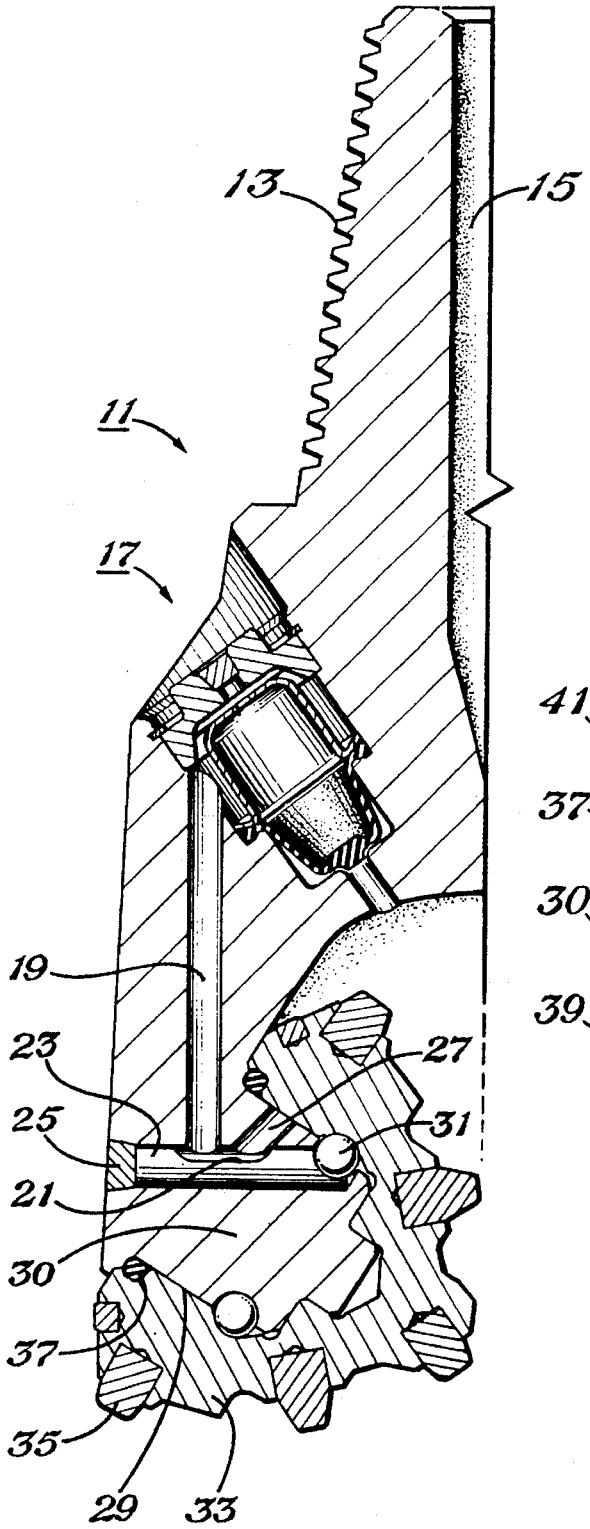
FIG. 1 is a longitudinal cross-section of one leg of an earth-boring bit according to the present invention.

FIG. 1 depicts, in a fragmentary section view, one section of an earth-boring bit 11 according to the present invention. Earth-boring bit 11 is provided with a body 12, which is threaded at its upper extent 13 for connection into a drill-string (not shown). A fluid passage 15 directs drilling fluid to a nozzle (not shown) that impinges drilling fluid against the borehole bottom to flush cuttings to the surface of the earth.

Earth-boring bit 11 is provided with a pressure compensating lubrication system 17. Preferably, a pressure compensating lubrication system is contained within each section of the body, there usually being three which are welded to form the composite body. Pressure compensating lubrication system 17 is vacuum pressure filled with lubricant at assembly. The vacuum pressure lubrication process also ensures that the journal bearing cavity generally designated as 18 is filled with lubricant through lubrication passage 19. Ambient borehole pressure acts through diaphragm 20 to cause lubricant pressure to be substantially the same as ambient borehole pressure.

As shown in FIG. 1, the lubricant passage 19 extends downwardly into intersection with another lubrication passage 21 in the upper portion of a ball plug 23 which is secured to the body by a plug weld 25. A third lubrication passage 27 carries lubricant to a cylindrical bearing surface 29 on a cantilevered bearing shaft 30 which is cantilevered downwardly and inwardly from an outer and lower region of the body of the bit.

The ball plug 23 retains a series of ball bearings that rotatably secure the cutter 33 to the bearing shaft 30. Dispersed in the cutter are a plurality of rows of earth disintegrating teeth 35 that are constructed of a sintered tungsten carbide secured by interference fit into mating holes in the cutter 33.

Figure 3:
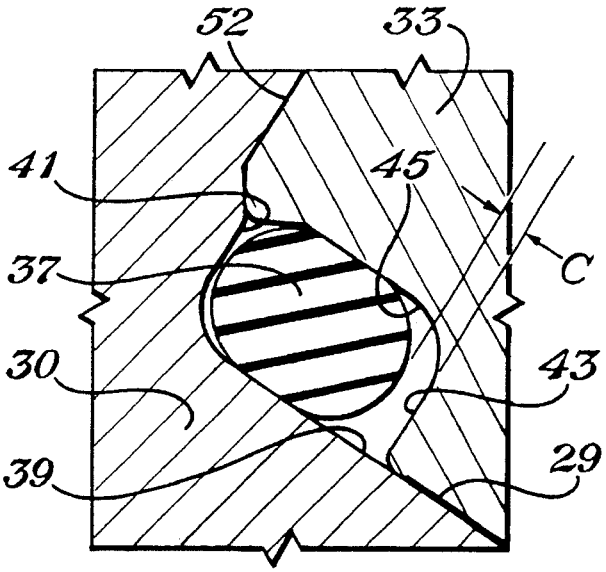
FIG. 3 is a fragmentary, longitudinal cross-section showing an enlarged view of the seal means and recess configuration of FIG. 1.

As shown in FIG. 3, a cylindrical seal surface 39 is formed near the base of the bearing shaft 30 to adjoin a radial seal surface 41, these surfaces being joined by a suitable radius. The seal surfaces 39, 41 are opposed by a radial seal surface 43 in the cutter 33, which also contains a cylindrical seal surface 45, these surfaces being joined by a suitable radius.

Figure 2:
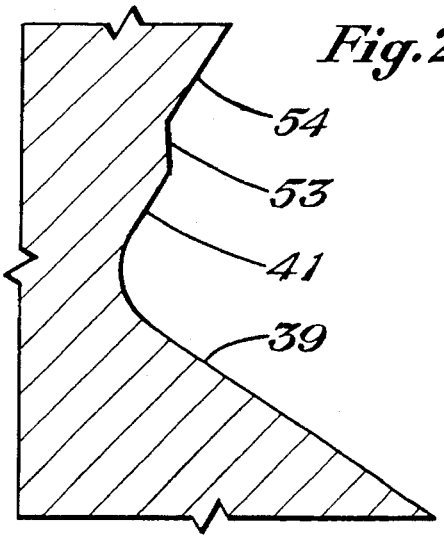
FIG. 2 is a fragmentary longitudinal section of a portion of the bit of FIG. 1, showing one region of the bearing shaft extended from the head.
Figure 4:
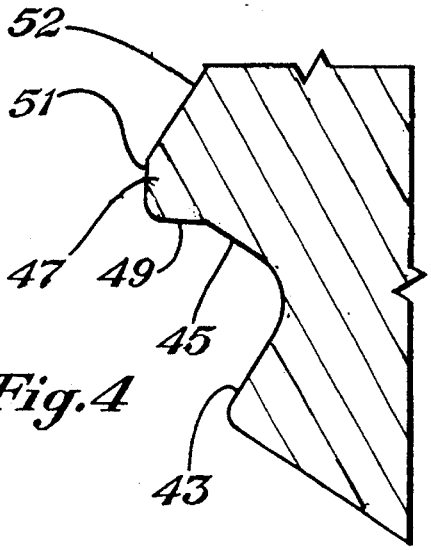
FIG. 4 is a fragmentary, longitudinal section of a portion of the cutter of the bit of FIG. 1.

In the particular bit configuration shown in FIGS. 2–4, a shroud 47 extends a selected distance inwardly of the cylindrical seal surface 45 in the cutter 33 toward the cylindrical surface 39 in the bearing shaft to bias the resilient packing ring, here an O-ring, 37 inwardly. The shroud is described in detail in U.S. Pat. No. 5,129,471, issued Jul. 14, 1992, and assigned to the assignee of the present invention. Preferably, this shroud 47 extends inwardly not more than about 30% of the cross-sectional thickness of the O-ring 37 in its relaxed condition before assembly on the bearing shaft 30. The O-ring 37 is preferably compressed between the cylindrical seal surfaces 39, 45 in a range of about 10 to 15%. As indicated in FIG. 3, the shroud 47 has an inward oblique surface 49 adapted to engage the O-ring 37 to bias it inwardly and away from radial seal surface 41. The shroud 47 also has an outward oblique surface 51 which opposes a parallel oblique surface 53 in the head, as indicated in FIG. 2. The cone backface 52 of FIG. 3 opposes the last machined surface 54 in the body of the bit. It will be understood that recess configurations for the O-ring 37 can assume various forms, depending upon the bit model and manufacturer. The utility of the present invention is not limited to the seal assemblies illustrated, but is useful in all manner of rotary rock bit seals having resilient seal elements which seal between a stationary and a rotating surface.

In the embodiment of the invention shown in FIG. 3, the resilient O-ring 37, when compressed, does not span the distance between radial seal surfaces 41, 43 of the head and cutter, but rather, has a length less the minimum length of the composite gland by distance "C." The composite recess should be approximately 30% greater in width than that of the O-ring when in its relaxed condition. The nominal squeeze of the O-ring is preferably 12% but in practice varies in a range from about 10 to 15%. Thus, the clearance C is sufficient to permit the O-ring 37 to move back and forth within the composite seal recess to compensate for pressure differences in the lubricant and minimize pressure pulses that otherwise may tend to push the O-ring outwardly in a manner to cause excessive heat, wear or extrusion.

The resilient bearing seal which is disposed in the seal receptacle of the drill bit of the invention is formed of a functionally modified, butadiene acrylonitrile copolymer rubber which is hydrogenated and which is modified by the addition of polar groups to the polymer backbone. The preferred polar groups are the carboxyl groups having the formula:

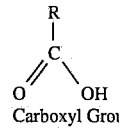

Carboxyl Group

The R represents a hydrocarbon group. Carboxyl groups may be obtained by copolymerizing such acids as acrylic acid, methylacrylic acid, sorbic acid, bacryloxypropionic acid, ethyl acrylic acid, 2-ethyl-3-propylacrylic acid, vinylacrylic acid, cinnamic acid, maleic acid and fumaric acid.

Carboxylated acrylonitrile butadiene rubbers, XNBR, have been known for several years and include such formulations as Nipon 1072EP sold by Zeon Chemical Inc. and the Chemigum NX775 sold by Goodyear Tire & Rubber Company. Typical oil field acrylonitrile butadiene rubbers, NBR, compounds will contain 30–50% acrylonitrile copolymerized with butadiene at 70% to 50%. XNBR is similar to these typical oil field NBR compounds with the exception around 7% by weight carboxylic acid has been added to the formulation and co-polymerized to the elastomer's molecule. The functional groups in the elastomer molecule of a conventional NBR and a commercially available XNBR have the formulas:

Conventional NBR

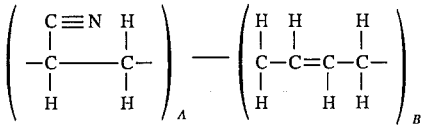

acrylonitrile group butadiene group

Conventional XNBR

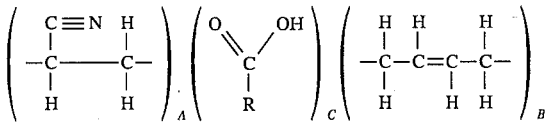

acrylonitrile group carboxyl group butadiene group

Another class of acrylonitrile butadiene rubber that has been known for several years is the hydrogenated nitrile elastomer or HNBR. This rubber is produced by a hydrogenation process which typically reduces 90% or more of the butadiene double bonds.

Conventional NBR

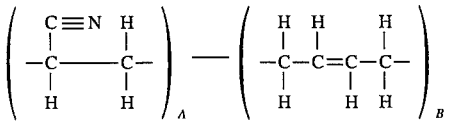

Hydrogenation to HNBR

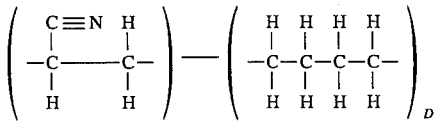

The preferred rubbers of this invention are similar to the previously described XNBR rubbers in that carboxylic acid has been added to the formulation and co-polymerized to the elastomer's polymer molecule and also to HNBR in that the double bonds in the butadiene molecule have been reduced resulting in a much greater degree of saturation with typical compound having about 88 to 92%, most preferably about 90% saturation. A suitable XHNBR polymer is commercially available from Zeon Chemicals Inc. as the Zetpol 2220 XHNBR polymer. These polymers have the following functional groups and properties:

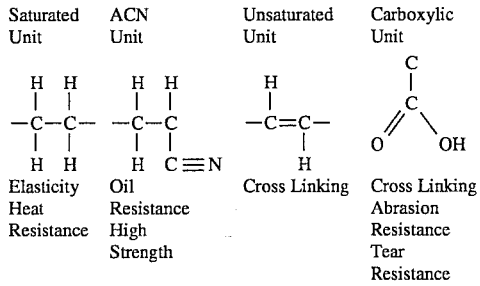

Functional Groups and Characteristic Properties

In addition to the XHNBR polymer the preferred O-ring rubber compound will include curing agents and fillers. It may also include small amounts of conventional plastizers, processing aids, pigments, reinforcing agents, antioxidants and the like. Typical O-ring rubber compound formulations using Zetpol 2220 XHNBR polymer from Zeon Chemicals Inc. and Zetpol 2020 HNBR polymer from Zeon Chemicals Inc. would be as follows.

| Ingredient | HNBR | XHNBR |
|---|---|---|
| Zetpol 2220 - XHNBR polymer | | 100.00 |
| Zetpol 2020 - HNBR polymer | 100.00 | |
| N550 Black - carbon black | 50.00 | 50.00 |
| Kadox 911C - zinc oxide | 5.00 | 5.00 |
| Plasthall TOTM - plastizer | 5.00 | 5.00 |
| Stearic Acid | 0.50 | 0.50 |
| Vanox ZMTI - antioxidant | 1.00 | 1.00 |
| Naugard 445 - antioxidant | 1.50 | 1.50 |
| Vul-cup 40 KE - organic peroxide | 8.00 | 8.00 |
| Total | 171.00 | 171.00 |

Amounts are expressed as parts per 100 parts polymer

In the production of the preferred O-ring compound made with the XHNBR polymer, the carboxylation contained in the XHNBR polymer is reacted with zinc oxide or other divalent metal oxide to form a very strong ionic bond. This strong ionic bond supplements the carbon to carbon bonds of the peroxide system for increased rubber strength. The following illustration shows the ionically bonded zinc in the XHNBR rubber compound:

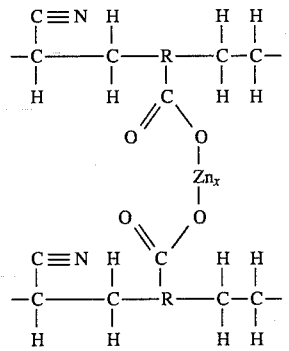

The O-ring compositions of the invention may be prepared by conventional methods, using a mixing device such as a rubber mill or, preferably, an internal mixer. In a typical process, the XHNBR polymer is added to an internal mixer and mixed for about 0.5 to 4 minutes, following which any antioxidants or processing aids are added and the mixing is continued for about 2 to 10 minutes. Any fillers, pigments, reinforcing agents, plasticizers or other additives may be added during this mixing cycle.

Following completion of this stage of mixing, the metal oxide or hydroxide and organic peroxide added to the mixer and mixing is continued for about 3 to 10 minutes. On completion of mixing, the formed compound is dumped from the mixer and formed into sheets on a two roll mill. These sheets can be readily formed into the desired shape or configuration by molding at temperatures around 200° C. Variations of the described process, including different times or temperatures, different orders of addition of ingredients, and the like, are envisioned. The actual process of preparing the formulations is not critical and the above description is illustrative only.

A comparison of physical, chemical and mechanical properties for the O-ring rubber compound formulations using Zetpol 2220 XHNBR polymer from Zeon Chemicals Inc. and Zetpol 2020 HNBR polymer from Zeon Chemicals Inc. follows:

COMPARISON OF HNBR TEST COMPOUND TO XHNBR TEST COMPOUND

| | HNBR | XHNBR |
|---|---|---|
| ORIGINAL PROPERTIES Cross Section = 0.250 in.) | | |
| Hardness, Shore A | 75 | 83 |
| Tensile strength, psi | 3353 | 4100 |
| Elongation, % | 243 | 204 |
| Load, lbs. force at 50% Elongation | 37.0 | 64.6 |
| Specific Gravity | 1.18 | 1.18 |
| Resilience, % vertical | 28 | 25 |
| COMPRESSION SET % OF ORIGINAL DEFLECTION | | |
| 70 hrs at 125° C.(257° F.) | 15 | 24 |
| FLUID AGING, ASTM NO. 1 OIL 24 HRS AT 100° C.(212° F.) | | |
| Weight Change, % | −0.6 | −0.4 |
| FLUID AGING, IRM 903 OIL 24 HRS AT 100° C.(212° F.) | | |
| Weight Change, % | +8.6 | +9.3 |
| ABRASION RESISTANCE, 5000 REVOLUTIONS, H18 ABRADER WITH 1000 g LOAD | | |
| Wt. loss per revolution, mg/rev. | 0.071 | 0.059 |

As shown in the above comparative tests, the XHNBR test compound has over a 15% improvement in weight loss per revolution as compared to a standard HNBR compound in the abrasion resistance test.

In operation, earth-boring bit 11 is attached to a drillstring (not shown) and run into a borehole for drilling operation. The drillstring and earth-boring bit 11 are rotated, permitting cutters 33 to roll and slide along the bottom of the borehole, wherein inserts or teeth 35 engage and disintegrate formation material. While cutters 33 rotate relative to body 12 of earth-boring bit 11, seal assemblies retain lubricant in bearing cavities 18, promoting the free rotatability of cutters 33 on bearing shafts 30.

The resilient seal elements of the present invention provide an improved seal assembly, and thus an earth-boring bit, having longer operational life. The ability of the seal assembly to withstand wear and operate longer than prior-art seals permits retention of lubricant in the bearing surfaces for longer periods of time, thus resulting in an earth-boring bit having increased life and therefore more economical operation.

The present invention has been described with reference to a preferred embodiment thereof. Those skilled in the art will appreciate that the invention is thus not limited, but is susceptible to variation and modification without departure from the scope and spirit thereof.

What is claimed is:

1. An improved seal assembly for use in a downhole wellbore tool of the type having a bearing disposed between a first member and a second member, the first member being rotatable relative to the second member, the improved seal assembly comprising:

a seal receptacle formed generally intermediate the first member and the second member;

a resilient bearing seal disposed in the seal receptacle, the resilient bearing seal being formed of a functionally modified, butadiene acrylonitrile copolymer rubber having a polymer backbone, which is hydrogenated and which is modified by the further addition of carboxyl polar groups to the polymer backbone.

2. The improved seal assembly of claim 1, wherein the resilient bearing seal is predominately formed of carboxylated hydrogenated acrylonitrile butadiene rubber.

3. The improved seal assembly of claim 2, wherein the carboxylated hydrogenated acrylonitrile butadiene rubber has a degree of saturation between about 88 to 92% saturated.

4. An earth-boring bit having an improved seal assembly, the earth-boring bit comprising:

a bit body;

at least one cantilevered bearing shaft, including a base and a bearing surface, extending inwardly and downwardly from the bit body;

at least one cutter mounted for rotation on the cantilevered bearing shaft;

a resilient bearing seal disposed between the bearing shaft and the cutter and proximally to the base of the cantilevered bearing shaft, the resilient bearing seal being formed of carboxylated hydrogenated acrylonitrile butadiene rubber.

5. An earth-boring bit having an improved seal assembly, the earth-boring bit comprising:

a bit body;

at least one cantilevered bearing shaft having an axis of rotation, including a base secured to the bit body and a cylindrical journal bearing surface, extending obliquely inward and downward;

a lubrication system in the body, including a hydrostatic pressure compensator;

an earth-disintegrating cutter secured for rotation about the cylindrical journal bearing surface;

a cutter seal groove partially formed by an outwardly facing radial wall;

a shaft seal groove formed in the base of the bearing shaft radially inward of the cylindrical journal bearing surface toward the axis of rotation, opposite the cutter seal groove;

a resilient sealing ring located in a selected one of the cutter seal groove and shaft seal groove, the resilient sealing ring being formed of a carboxylated hydrogenated acrylonitrile butadiene rubber.

6. The earth boring bit of claim 5, wherein the resilient sealing ring is an O-ring.

7. The earth boring bit of claim 6, wherein the carboxylated hydrogenated acrylonitrile butadiene rubber has a degree of saturation between about 88 to 92% saturated.

8. An earth boring bit having at least one cantilevered bearing shaft and a cutter rotatably mounted on the shaft, bearing surfaces between the shaft and cutter being lubricated by an internal supply of a hydrocarbon containing lubricant during operation of the bit, the earth boring bit further comprising:

a resilient O-ring seal disposed within an annular chamber formed between the shaft and cutter, the O-ring being comprised predominately of a carboxylated hydrogenated acrylonitrile butadiene rubber compound.

9. The earth boring bit of claim 8, wherein the carboxylated hydrogenated acrylonitrile butadiene rubber has a degree of saturation between about 88 to 92% saturated.

* * * * *